US010054267B2

(12) United States Patent
Yersak et al.

(10) Patent No.: US 10,054,267 B2
(45) Date of Patent: Aug. 21, 2018

(54) PRESSURE VESSEL ARRAY

(71) Applicant: GM GLOBAL TECHNOLOGY OPERATIONS LLC, Detroit, MI (US)

(72) Inventors: Thomas A. Yersak, Madison Heights, MI (US); Jerome P. Ortmann, Shelby Township, MI (US); Mahmoud H. Abd Elhamid, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 55 days.

(21) Appl. No.: 15/167,625

(22) Filed: May 27, 2016

(65) Prior Publication Data

US 2017/0343162 A1 Nov. 30, 2017

(51) Int. Cl.

*B65D 43/04* (2006.01)
*F17C 13/08* (2006.01)
*F17C 1/14* (2006.01)

(52) U.S. Cl.

CPC ..... *F17C 13/083* (2013.01); *F17C 1/14* (2013.01); *F17C 2201/0104* (2013.01); *F17C 2201/035* (2013.01); *F17C 2203/0639* (2013.01); *F17C 2203/0643* (2013.01); *F17C 2203/0646* (2013.01); *F17C 2205/0134* (2013.01); *F17C 2221/033* (2013.01); *F17C 2270/0168* (2013.01)

(58) Field of Classification Search

CPC .. F17C 13/083; F17C 1/14; F17C 2270/0168; F17C 2221/033; F17C 2205/0134; F17C 2203/0646; F17C 2203/0639; F17C 2201/035; F17C 2201/0104; F17C 2203/064

USPC ..... 220/581–592, 560.04–560.15, 562–564, 220/565–567, 567.1–567.3

See application file for complete search history.

(56) References Cited

U.S. PATENT DOCUMENTS

| | | | | |
|---|---|---|---|---|
| 4,021,895 | A * | 5/1977 | Morse | F24J 2/04 126/400 |
| 6,047,860 | A | 4/2000 | Sanders | |
| 8,671,932 | B2 * | 3/2014 | Eck | F22B 1/006 126/569 |
| 9,249,931 | B2 | 2/2016 | Morales et al. | |
| 9,249,933 | B2 | 2/2016 | Morales et al. | |
| 2010/0230422 | A1 * | 9/2010 | Illesi | F17C 1/06 220/586 |

(Continued)

FOREIGN PATENT DOCUMENTS

| | | | |
|---|---|---|---|
| CN | 107435813 | A | 12/2017 |
| DE | 102017111500 | A1 | 11/2017 |
| WO | WO-2016130156 | A1 | 8/2016 |

OTHER PUBLICATIONS

NIST Handbook 44 Appendix D, 2016, 30 pages.

(Continued)

*Primary Examiner* — Kareen Thomas

(74) *Attorney, Agent, or Firm* — Harness, Dickey & Pierce, P.L.C.

(57) ABSTRACT

An array of pressure vessels for storage of a compressed gas includes at least one Type 4 pressure vessel and at least one Type 1 pressure vessel. The Type 1 pressure vessel is in fluid communication with the at least one Type 4 pressure vessel. A metal wall of the at least one Type 1 pressure vessel has a Type 1 thermal conductance that is greater than a Type 4 thermal conductance of the at least one Type 4 pressure vessel.

17 Claims, 4 Drawing Sheets

(56) References Cited

U.S. PATENT DOCUMENTS

| | | | | |
|---|---|---|---|---|
| 2014/0174152 | A1* | 6/2014 | Gil | G01N 7/00 73/25.01 |
| 2014/0290283 | A1 | 10/2014 | Ortmann et al. | |
| 2014/0290611 | A1 | 10/2014 | Abd Elhamid et al. | |
| 2014/0290751 | A1 | 10/2014 | Dailly et al. | |
| 2014/0290789 | A1 | 10/2014 | Dailly et al. | |
| 2014/0291048 | A1 | 10/2014 | Morales et al. | |
| 2015/0048095 | A1 | 2/2015 | Sanders | |
| 2015/0083733 | A1 | 3/2015 | Abdel-Baset | |
| 2015/0226139 | A1 | 8/2015 | Dailly et al. | |
| 2015/0362125 | A1 | 12/2015 | Morales et al. | |
| 2016/0097348 | A1 | 4/2016 | Abd Elhamid et al. | |
| 2017/0067415 | A1 | 3/2017 | Cai et al. | |

OTHER PUBLICATIONS

"Gas cylinders—High pressure cylinders for the on-board storage of natural gas as a fuel for automotive vehicles" International Standard ISO 11439, Second edition 2013 78pgs.

Piellisch, Rich, "GSD: Conformable Onboard CNG", Fleets and Fuels.com, 2014, 2pgs, http://www.fleetsandfuels.com/fuels/cng/2014/10/gsd-for-conformable-onboard-cng/.

Mahmoud H. Abd Elhamid et al.; U.S. Appl. No. 15/223,922, filed Jul. 29, 2016 entitled "Vehicle With Natural Gas Storage Array"; 34 pages.

* cited by examiner

PRESSURE VESSEL ARRAY

BACKGROUND

Pressure vessels, such as, e.g., gas storage containers and hydraulic accumulators may be used to contain fluids under pressure. Some gas storage tanks are filled to a threshold pressure. The density of gases depends on the pressure and the temperature of the gas. For example, on a hot day, the gas will expand, and the tank may only fill to 75% (or less) of its potential. During refueling, the gas compresses into the tank and the temperature inside of the tank increases. As an example, in a high pressure system, the tank may be filled at a pressure of about 3,600 psi and an average temperature of about 50° C. (≈122° F.). After fueling, the temperature of the tank decreases (e.g., to the ambient temperature), and the pressure also decreases proportionally. In an example, the tank pressure decreases to 3,400 psi and this amounts to a thermodynamically induced underfill of about 6%.

According to ISO (International Organization for Standardization) 11439-Second Edition, a gas cylinder of Type 1 design is an all metal cylinder. A Type 2 design is a hoop wrapped cylinder with a load sharing metal liner and composite reinforcement on the cylindrical part only. A Type 3 design is a fully wrapped cylinder with a load sharing metal liner and composite reinforcement on both the cylindrical part and dome ends. A Type 4 design is a fully wrapped cylinder with a non-load sharing liner and composite reinforcement on both the cylindrical part and dome ends.

SUMMARY

An array of pressure vessels for storage of a compressed gas includes at least one Type 4 pressure vessel and at least one Type 1 pressure vessel. The Type 1 pressure vessel is in fluid communication with the at least one Type 4 pressure vessel. A metal wall of the at least one Type 1 pressure vessel has a Type 1 thermal conductance that is greater than a Type 4 thermal conductance of the at least one Type 4 pressure vessel.

BRIEF DESCRIPTION OF THE DRAWINGS

Features of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
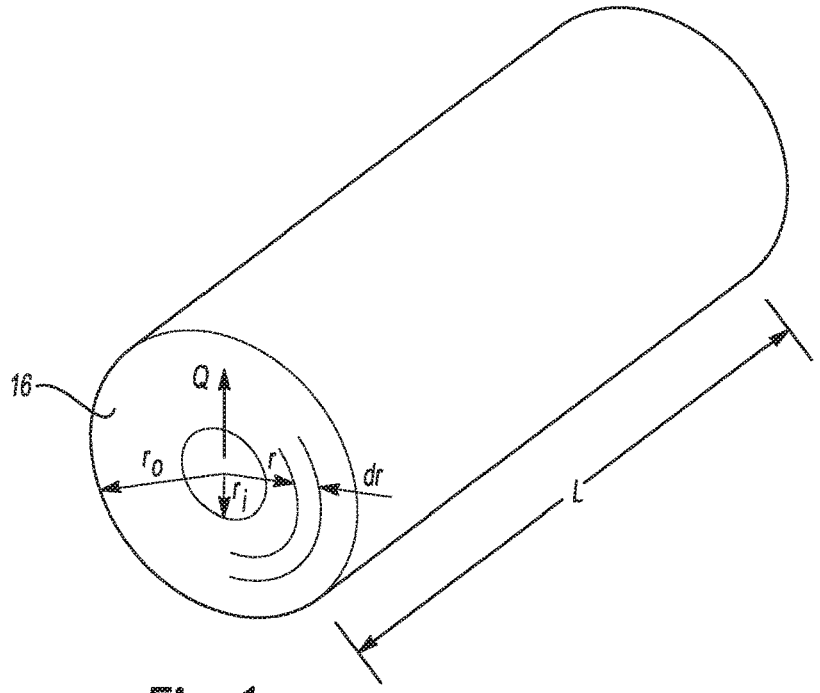
FIG. 1 is a semi-schematic perspective view of a cylinder with dimensions labeled for use with example calculations of thermal conductance provided herein.

Natural gas vehicles are fitted with on-board storage tanks. Some natural gas storage tanks are designated low pressure systems, and these systems are rated for pressures up to about 750 psi. In an example, the low pressure systems are rated for pressures of about 725 psi and lower. During refueling, the container of the low pressure system storage tank is designed to fill until the tank achieves a pressure within the rated range. Other natural gas storage tanks are designated high pressure systems, and these systems are rated for pressures ranging from about 3,000 psi to about 3,600 psi. Similar to low pressure system storage tanks, the container of the high pressure system storage tank is designed to fill until the tank achieves a pressure within the rated range. Since the tanks of the present disclosure may be pressurized, the term "tank" may be interchanged with "pressure vessel" in the present disclosure.

As used herein, refueling means the introduction of a quantity of natural gas into a container to increase the quantity of the natural gas in the container. Refueling of natural gas containers is typically accomplished by connecting the natural gas container to a high pressure source. The fuel flows from the high pressure source into the natural gas container. When the pressure difference between the source and the natural gas container is high, the flow rate is generally higher than when the pressure difference is small. At very high pressure differences, flow rate may be limited by the speed of sound. This may be called choked flow, or critical flow. As the natural gas container fills, the pressure difference is reduced. When the pressure difference becomes low, the flow rate slows. When the pressure of the natural gas inside the container equals the pressure of the source, the flow stops. However, it is typical for refueling to be terminated before the tank actually reaches the source pressure. Typically, refueling is terminated when the tank reaches a target pressure that is somewhat lower than the source pressure. In some cases, refueling may be terminated when the flow rate falls to a target flow rate. In some cases, the flow rate may be measured by a flow meter, in other cases, the flow rate may be estimated from a rushing sound caused by the flow.

Unlike liquid fuel, natural gas can expand and contract significantly depending on the gas pressure and the temperature. For example, on a hot day, the gas will expand, and the tank may only fill to 75% (or less) of its potential (based on mass of the gas). During refueling, the natural gas compresses into the tank and the temperature of the natural gas inside of the tank increases. The work done to compress the gas increases the internal energy of the gas. The increase in internal energy is, in part, reflected in an increase in the temperature of the gas. As an example, in a high pressure system, the tank may be filled at a pressure of about 3,600 psi and at a temperature of about 50° C. (≈122° F.). After fueling, the temperature of the tank slowly decreases (e.g., to the ambient temperature), and the pressure will decreases proportionally to the temperature. In an example, the tank pressure decreases to 3,400 psi and this amounts to a thermodynamically induced underfill of about 6%. As used herein, thermodynamically induced underfill means a difference between a mass of natural gas loaded into a container and a service capacity of the container. For example, some CNG (Compressed Natural Gas) containers may be rated at 3,600 psi. As used herein, the service capacity of the CNG container rated at 3,600 psi is the mass of the natural gas stored in the container at 3,600 psi and 15° C. (degrees Celsius).

There are currently two main types of CNG dispensing systems: time-fill and fast-fill. The main structural differences between the two systems are the amount of storage capacity available and the size of the compressor. These factors determine the total amount of fuel dispensed and time it takes for CNG to be delivered.

Fast-fill stations receive fuel from a local utility line at a low pressure and then use a compressor on site to compress the gas to a high pressure. Once compressed, the CNG moves to storage vessels so the pressurized fuel is available for a quick fill-up. Refueling time at a fast-fill station is about the same as for refueling with gasoline at a conventional gasoline fueling station—less than 5 minutes for a 20 GGE tank. CNG at fast-fill stations may be stored in the storage vessels at a high service pressure (4,300 psi).

Some natural gas fill stations are known as ultra-fast fill. Ultra-fast fill stations are intended for large vehicles with very large tanks to keep the fill times at approximately the same as the fill times for a large diesel tank. It is to be understood that faster filling causes the heat of compression to accumulate faster in the tank, thereby increasing the temperatures experienced by the tank. Examples of the present disclosure may be sized to dissipate the heat associated with ultra-fast fill dispensing systems.

At a time-fill station, a fuel line from a utility delivers fuel at a low pressure to a compressor. Unlike fast-fill stations, vehicles at time-fill stations are generally filled directly from the compressor, not from pressurized fuel stored in tanks. Although there may be a small buffer storage tank, the buffer tank is not large enough to not to fill the tanks on a vehicle. The purpose of the buffer tank is to keep the compressor from turning off and on unnecessarily consuming electricity and causing additional wear and tear on the compressor.

The time it takes to fuel a vehicle at a time-fill station depends on the number of vehicles having tanks simultaneously filled, compressor size, and the amount of buffer storage. Vehicles may take several minutes to many hours to fill. Refueling at a time-fill stations may cause a smaller temperature rise from compression of the gas than refueling at a fast-fill station.

The United States National Institute of Standards and Technology (NIST) has defined a GGE (Gasoline Gallon Equivalent) as 5.660 pounds of natural gas. The NIST was using a U.S. Gallon which is equivalent to 3.78541 Liters. NIST also defined a GLE (Gasoline Liter Equivalent) as 0.678 kilograms of natural gas.

It is recognized that most existing natural gas fuel containers will naturally tend toward thermal equilibrium with their environment according to the second law of thermodynamics. As such, unless a tank is perfectly insulated, it will eventually cool by radiation, convection and conduction until thermal equilibrium with the environment is reached. However, some natural gas fuel containers cool much more quickly than others.

The rate of heat transfer through a wall of a natural gas fuel container is influenced by the thermal conductance C of the wall. The definition of thermal conductance C has some variation in the art. As used herein, thermal conductance means the ability of a wall to transfer heat per unit time, given one unit area of the wall and a temperature gradient through a unit thickness of the wall. It is measured in Watts per degree Kelvin (W/K). The thermal conductance C of a wall is greatly influenced by the thermal conductivity k of the wall material and the construction (i.e. thickness, surface area, etc.) of the wall. Like thermal conductance C, the definition of thermal conductivity k also has some variation in the art. As used herein, thermal conductivity k means the quantity of heat (Q) transmitted through a unit thickness (Δx) in a direction normal to a surface of unit area (A) due to a unit temperature gradient (ΔT) under steady state conditions and when the heat transfer is dependent only on the temperature gradient. The units of thermal conductivity k are Watts per meter per degree Kelvin (W/(m·K)). Thus, the thermal conductance C of a wall that is made of a single material is the quotient of the thermal conductivity k of the material divided by the thickness of the wall for a unit area of the wall.

For example, consider a wall made of stainless steel with a thickness of 2 centimeters. The thermal conductivity k of stainless steel is about 20 W/(m·K), so the thermal conductance C of a unit area of the stainless steel wall is about 20 W/(m·K)·1 $m^2$÷0.02 m=1000 W/K. For comparison, a composite wall with a Hytrel® liner may have an overall thermal conductivity of about 0.1 W/(m·K). As used herein, overall thermal conductivity is the thermal conductivity of a composition of at least 2 materials. Overall thermal conductivity is convenient for analysis because it allows a wall that has multiple layers of materials to be considered as a single material. Assuming that the composite wall in this calculation example is also 2 centimeters thick, the thermal conductance for a unit area of the composite wall is 0.1 W/(m·K)·1 $m^2$÷0.02 m=5 W/K. Thus, the stainless steel wall in the example calculation has 1000 W/K÷5 W/K=200 times the thermal conductance C of the composite wall.

If the wall under consideration is a thick cylindrical wall, it is not accurate to use the inside area or the outside area for determining absolute thermal conductance $C_{abs}$. As used herein, absolute thermal conductance $C_{abs}$ means the thermal conductance of an object in W/K, and is distinct from thermal conductance C, which is W/K "for a unit area". Using a log mean area ($A_{lm}$) resolves the issue. $A_{lm}=2\pi L(r_o-r_i)\div\ln(r_o/r_i)$ An example calculation of absolute thermal conductance $\underline{C_{abs}}$ for a stainless steel tank segment follows:

outside diameter=0.0383 m; wall thickness=5.35 mm; and Length (L)=0.75 m $r_o$=0.0383 m/2=0.0192 m; $r_i$=0.0192 m−0.00535 m=0.0139 m $$C_{abs}=kA_{lm}\div(r_o-r_i)=k2\pi L(r_o-r_i)\div\ln(r_o/r_i)\div(r_o-r_i)$$
$$=k2\pi L\div\ln(r_o/r_i)$$

$$\underline{C_{abs}}=20\text{ W/(m·K)}2\pi 0.75\text{m}\div\ln(0.0192/0.0139)$$

$\underline{C_{abs}}$=290 W/K—note that this does not include end effects.

Fourier's law can be written in equation form as follows:

$$Q=-k\,A\Delta T\div\Delta x$$

For a cylinder with a wall made from single layer of a material as illustrated in FIG. 1, with boundary conditions:

Temperature=$T_i$ at inside radius $r_i$ and Temperature=$T_o$ at outside radius $r_o$, the quantity of heat transferred is:

$$Q=k2\pi L(T_i-T_o)\div\ln(r_o/r_i)$$

Figure 2:
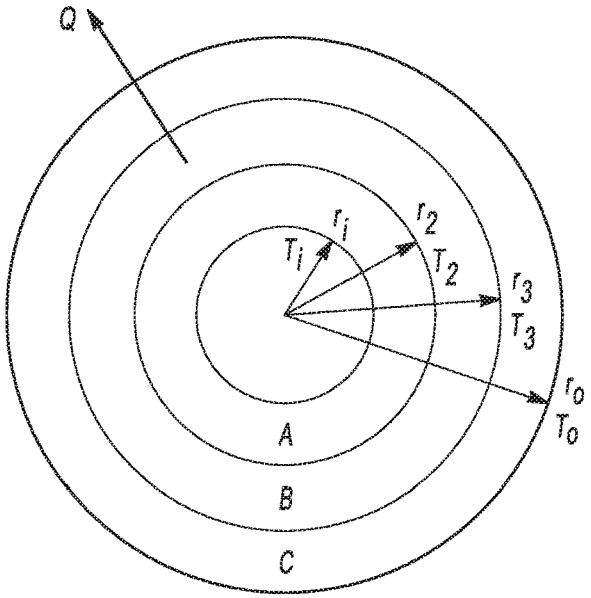
FIG. 2 is a semi-schematic cross-sectional view of a cylinder with a 3-layer wall for use with example calculations of thermal conductance provided herein.

For a three layer cylinder as illustrated in FIG. 2, the quantity of heat transferred is:

$$Q=2\pi L(T_i-T_o)\div(\ln(r_2/r_i)/k_A+\ln(r_3/r_2)/k_B+\ln(r_o/r_3)/k_C)$$

It is to be understood that although the examples shown above are based on a steady-state analysis, and with assumptions that k is independent of temperature and that end effects are negligible, the thermal conductance of an actual natural gas fuel container has similar influence on heat transfer under transient conditions (i.e. during fast fill). Therefore a natural gas fuel container with a higher thermal conductance will transfer heat more quickly than a natural gas fuel container with a lower thermal conductance, all else being equal.

Pressure vessels, according to examples of the present disclosure, may be conformable tanks. As used herein, "conformable" means the tank efficiently uses available space defined by a surface. The available space may be an irregular space, having pockets extending from a main space. For example, a body panel inner surface, or a floor surface of a vehicle that defines the space available for a tank may be curved for aesthetic appeal, structural stiffness, or other reasons. Struts, bosses, ridges, and other structural shapes may be formed into the body panel. In some cases, a single classic cylindrical pressurized gas tank may not efficiently use space adjacent to such shapes. An example conformable tank of the present disclosure may fit within the shape of the body panel or floor that defines the available space with a minimum of unused space. As such, examples of the conformable tanks of the present disclosure use space more efficiently than a classic cylindrical pressurized gas tank. A single cylindrical tank is not considered a conformable tank in the present disclosure, even if the space available is cylindrical, for example, in a rocket. As used herein, conformable does not mean that the tank cylinder is elastic, resiliently taking the available shape like a rubber balloon inflated in a box.

Conformability of tanks may be compared by determining a conformability factor. As used herein, conformability factor means a ratio of an outer tank volume divided by an enclosing rectangular cuboid volume. For example, the conformability of the cylindrical tank 18 shown in FIG. 3 may be calculated as follows:

$$V_{tank}=\frac{4}{3}\pi r_{end}^3+\pi r_{end}^2 L$$

$$V_{cuboid}=(2r_{end})^2*(2r_{end}+L)$$

$$\text{Conformability}=\frac{V_{tank}}{V_{cuboid}}*100\%$$

In an example, let L=37.25 inch; and $r_{end}$=8.1 inch. Conformability=67%

Figure 3:
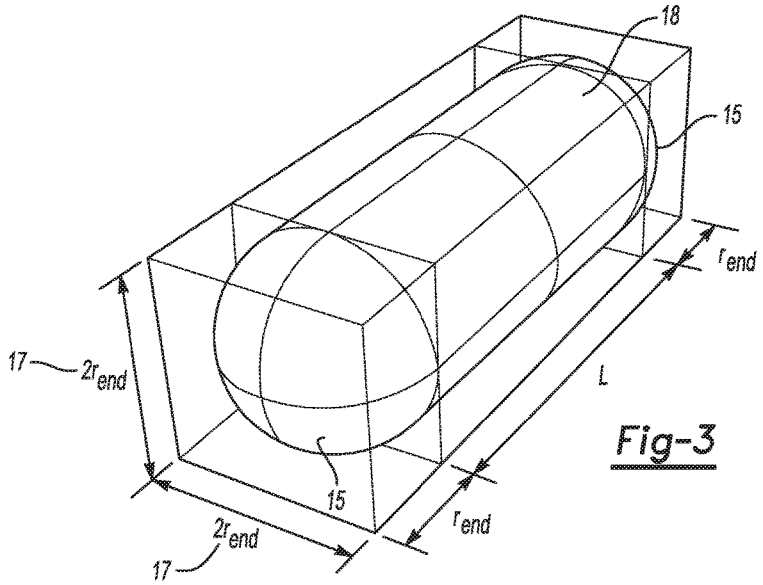
FIG. 3 is a perspective view of a cylindrical tank with hemispherical ends and an enclosing rectangular cuboid with dimensions shown for use in an example calculation of a conformability factor.

If the tank depicted in FIG. 3 has 0.5 inch (1.27 cm) thick steel walls and the dimensions $r_{end}$ and L given above, the tank would weigh about 257 lbs (117 kg) and have an internal volume of about 93 liters. In certain tank shapes, for example a sphere (conformability factor=52%) or a right circular cylinder (conformability factor=78%), the conformability factor is independent of the actual dimensions of the tank. The conformability factor for a cylindrical tank 18 with hemispherical ends 15 tends to be independent of size when L is much larger than the diameter 17. In FIG. 3, the diameter 17 is the same as $2r_{end}$. Therefore, for high aspect ratio pressure vessels, the conformability tends to be independent of size. As used herein, "aspect ratio" of a pressure vessel means a ratio of the length L of the pressure vessel to the diameter 17 of the pressure vessel. Conformable pressure vessels may have aspect ratios greater than about 10. In some examples of the present disclosure, the aspect ratio of conformable pressure vessels may be greater than 1440.

The space available for a natural gas tank may be, for example, in a vehicle cargo storage area or trunk. As such, space occupied by the natural gas tank is not available for cargo in the vehicle. Therefore, efficient use of space by a natural gas tank may be desirable.

One standard for measuring usable cargo space in a vehicle may be found in SAE J1100, Revised September 2005, Section 7, Cargo Dimensions and Cargo Volume Indices. SAE J1100 calls for luggage capacity to be determined by fitting a number of standard luggage pieces into the luggage space. As such, some "unusable" space will remain between the standard luggage pieces and the curved surfaces of the inner body panels that define the luggage space. Other space may be determined to be unusable for luggage if one of the standard luggage pieces will not fit in the space. Examples of the present disclosure may efficiently use available space for tanks to minimize the effect of the tank on luggage capacity. Other examples of the present disclosure may efficiently use available space for tanks to make space available for other purposes.

Figure 4:
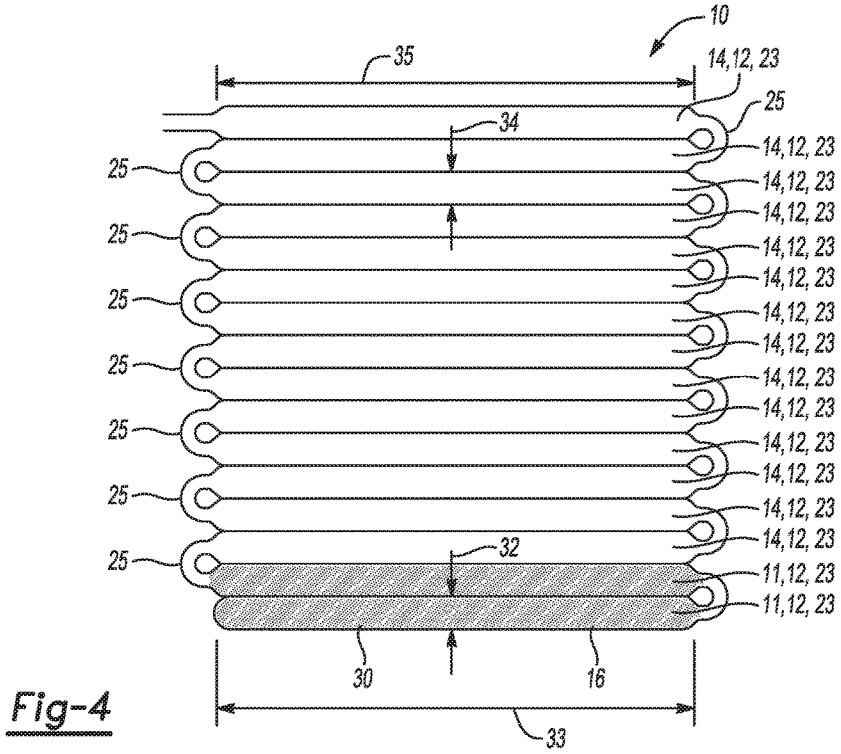
FIG. 4 is a semi-schematic front view of an example of an array of pressure vessels according to the present disclosure.
Figure 5:
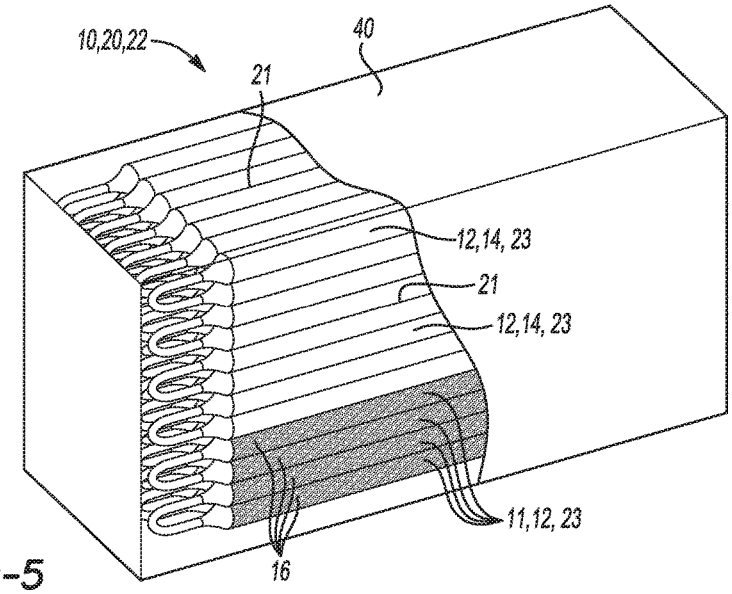
FIG. 5 is a semi-schematic perspective view of an example of a two-dimensional array of pressure vessels in an enclosure with the wall of the enclosure shown partially cut away according to the present disclosure.
Figure 6:
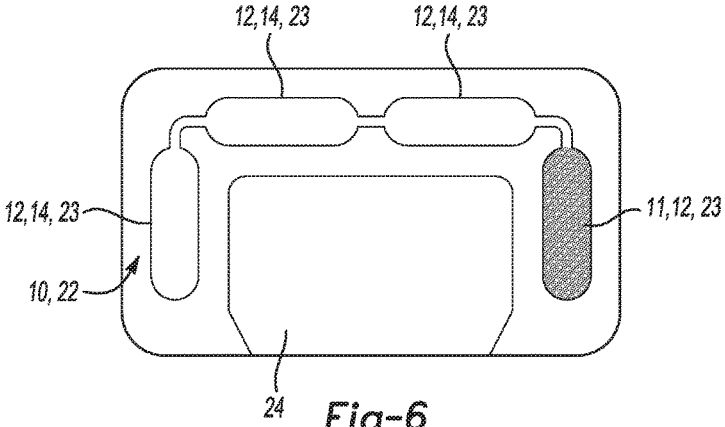
FIG. 6 is a top, schematic view of an automotive vehicle trunk, showing an example of an array of pressure vessels connected together and distributed about portions of the trunk according to the present disclosure.
Figure 7:
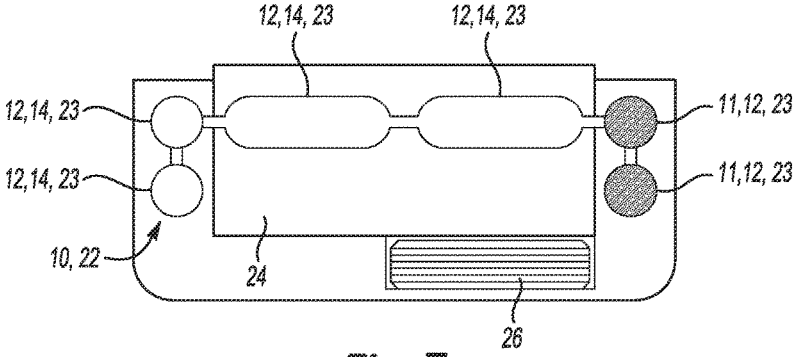
FIG. 7 is a rear, schematic view of the automotive vehicle trunk space, showing an example of an alternate arrangement of an array of pressure vessels connected together and distributed about portions of the trunk according to the present disclosure.

In examples of the present disclosure, an array 10 of serially connected pressure vessels 12 may also be called a segmented conformable pressure vessel 22. Each serially connected pressure vessel 12 may also be called a tank segment 23. FIG. 4 and FIG. 5 are examples of segmented conformable pressure vessels 22. A segmented conformable pressure vessel 22 of the present disclosure may visually resemble a string of sausage links. Connector tubes 25 connect each tank segment 23 of the segmented conformable pressure vessel 22. The connector tubes 25 may be flexible, and the tank segments 23 may be placed in a volume for efficient use of the space as illustrated in FIG. 5, FIG. 6, and FIG. 7.

The refill dynamics of some non-conformable and semi-conformable pressure vessels with aspect ratios less than or equal to 3.6 has been previously studied. Such low aspect ratios promote a uniform in-tank temperature profile because pressure work heated in-tank gas is efficiently mixed with cooler incoming gas by turbulent re-circulation.

FIG. 4 is a semi-schematic front view of an example of an array 10 of pressure vessels 12 according to the present disclosure. In examples of the present disclosure, an array 10 of pressure vessels 12 for storage of a compressed gas includes at least one Type 4 pressure vessel 14 and at least one Type 1 pressure vessel 11. The at least one Type 1 pressure vessel 11 is in fluid communication with the at least one Type 4 pressure vessel 14. Therefore, the array 10 of pressure vessels 12 has a minimum of two pressure vessels 12: a Type 4 pressure vessel 14 and a Type 1 pressure vessel 11.

In examples of the present disclosure, the at least one Type 4 pressure vessel 14 may be a plurality of Type 4 pressure vessels 14 in series fluid communication. For example, there may be three Type 4 pressure vessels 14; 10 Type 4 pressure vessels 14; 30 Type 4 pressure vessels 14 or any number of Type 4 pressure vessels 14 connected in series.

Similarly, the at least one Type 1 pressure vessel 11 may be a plurality of Type 1 pressure vessels 11 in series fluid communication. For example, there may be two Type 1 pressure vessels 11; 4 Type 1 pressure vessels 11; 10 Type 1 pressure vessels 11 or any number of Type 1 pressure vessels 11 connected in series. In order to maximize the weight-saving potential of the Type 4 pressure vessels 14, the number of Type 1 pressure vessels 11 may be minimized in the array 10 to the smallest number that meets temperature objectives during refill. In the example that provided the computer simulation test results described below, the array 10 had 14 Type 4 pressure vessels 14 and two Type 1 pressure vessels 11 with a total volume of 14 Liters.

The Type 4 pressure vessels 14 may be sequenced to receive a gas before the at least one Type 1 pressure vessel 11 when the gas is introduced into the array 10 of pressure vessels 12. The array 10 of pressure vessels 12 may terminate with the at least one Type 1 pressure vessel 11. This means that the at least one Type 1 pressure vessel 11 is the most downstream pressure vessel 12 in the array 10 during filling. In other examples, the Type 1 pressure vessel(s) 11 may be interspersed throughout the array 10, interrupting the sequence of the Type 4 pressure vessels 14 with Type 1 pressure vessels 11. In examples where the array 10 of pressure vessels 12 is a two-dimensional array 20 as shown in FIG. 5, the Type 1 pressure vessels 11 may be arranged to be at the outside 21 of the two-dimensional array 20 for maximum heat rejection to the surrounding environment. Here, two-dimensional means the array 20 has more than one row, and more than one column. It is to be understood that pressure vessels 12 in a two-dimensional array 20 may be connected to communicate fluid as a single series. As depicted in FIG. 5, in examples of the present disclosure, the array 10 may be disposed in an enclosure 40. The enclosure 40 may be vented to allow natural convection cooling, or unvented. The enclosure 40 may have cool air or another coolant forced therethrough by a fan or a pump (not shown).

A metal wall 16 of the at least one Type 1 pressure vessel 11 has a Type 1 thermal conductance that is greater than a Type 4 thermal conductance of the at least one Type 4 pressure vessel 14. As used herein Type 1 thermal conductance means the thermal conductance associated with the Type 1 pressure vessel; and Type 4 thermal conductance means the thermal conductance associated with the Type 4 pressure vessel. "Type 1" and "Type 4" are used to differentiate the respective thermal conductance associated with the different types of pressure vessels. Thus, "Type 1" and "Type 4" are used so that the reader knows that the thermal conductance of the Type 1 tanks is not referring to the thermal conductance of the Type 4 tanks. "Type 1" and "Type 4" are similarly used to differentiate the respective aspect ratios associated with the different types of pressure vessels. "Type 1" and "Type 4" are similarly used to differentiate the outer diameters and lengths associated with the different types of pressure vessels.

In examples of the present disclosure, the at least one Type 4 pressure vessel 14 may have a Type 4 aspect ratio greater than or equal to 10. The at least one Type 1 pressure vessel 11 may also have a Type 1 aspect ratio greater than or equal to 10. As depicted in FIG. 4, a Type 1 pressure vessel 11 may have substantially the same external dimensions as the Type 4 pressure vessel 14 so that a Type 1 pressure vessel 11 may be directly substituted for a Type 4 pressure vessel 14 in an array 10. As used herein, "substantially the same external dimensions" means the external dimensions are the same within manufacturing tolerances. The heat exchange surface area of the Type 4 pressure vessel 14 and the Type 1 pressure vessel 11 would be the same within manufacturing tolerances. For example, both types of pressure vessels may be smooth cylinders, or both may have fins defined in the outer surface. However, examples of the present disclosure do not apply fins to the Type 1 pressure vessel unless there are fins on the Type 4 pressure vessel as well. For example, a Type 1 outer diameter 32 of the at least one Type 1 pressure vessel 11 is equal to a Type 4 outer diameter 34 of the at least one Type 4 pressure vessel 14 within manufacturing tolerances. In the example a Type 1 length 33 of the at least one Type 1 pressure vessel 14 is equal to a Type 4 length 35 of the at least one Type 4 pressure vessel 14 within manufacturing tolerances. In other examples, the Type 1 pressure vessel 11 may have different external dimensions compared to the Type 4 pressure vessels 14 in an array 10.

Examples of the present disclosure advantageously enable high aspect ratio conformable pressure vessels to keep the temperature down even when a fast-fill system is used for refueling.

The inventors of the present disclosure have discovered that inefficient mixing of pressure work heat during fast-fill causes in-tank temperatures to locally exceed 85° C. in high aspect ratio Type 4 tanks.

Inefficient mixing of gas heated by pressure work in high aspect ratio Type 4 conformable tanks may lead to a non-uniform in-tank temperature distribution during refill. Some existing Type 4 conformable tanks are made with thermally insulating materials that cannot efficiently dissipate heat. Locally, the temperature may exceed guidelines for certain materials used in some Type 4 tanks. In examples of the present disclosure, some of the Type 4 conformable tank segments are replaced with stainless steel or aluminum Type 1 tank segments of similar geometry to the Type 4 conformable tank segments. Stainless steel has a thermal conductivity of about 20 W/(m·K); and aluminum has a thermal conductivity of about 163 W/(m·K). In other examples, the Type 1 tanks may be made from any material such that the thermal conductivity of the at least one Type 1 pressure vessel is at least about 20 W/(m·K).

Stainless steel or aluminum Type 1 pressure vessels can efficiently dissipate pressure work heat at a much faster rate than Type 4 pressure vessels made from Hytrel®, Kevlar®, or carbon fiber. The stainless steel or aluminum Type 1 pressure vessels of the present disclosure more efficiently dissipate pressure work heat compared to Type 4 pressure vessels with the same volume capacity, length and wall thickness. There are two mechanisms that increase the efficiency of the dissipation of pressure work heat: convection and wall heat capacity. 1. Convection: The higher thermal conductivity of a Type 1 pressure vessel material allows the outer surface of the Type 1 pressure vessel to heat up faster and therefore transfer more heat to the environment by natural convection; $Q=hA(Tw-Tenv)$. Q=heat flow per unit time. h=convective heat transfer coefficient, A=surface area Radiation loses are negligible. 2. Wall heat capacity: If the thickness of the wall is kept constant, then a Type 1 pressure vessel wall will have a higher overall heat capacity than the Type 4 pressure vessel wall.

An example of the present disclosure was tested by computer modeling using COMSOL Multiphysics' turbulent flow and heat transfer modules. The simulated segmented conformable tank had 16 tank segments in series to give a 14 L capacity. The computer model simulated a 5 minute fast refill from 0 psig (pounds per square inch gage) to 3600 psig. The baseline was a segmented conformable Type 4 pressure vessel with a Hytrel® liner and a braided Kevlar® outer lining. The thermal conductivity of these materials is approximately 0.1 W/(m·K). An example of the present disclosure had the last 2 segments of the baseline replaced with Type 1 stainless steel segments.

Figure 8:
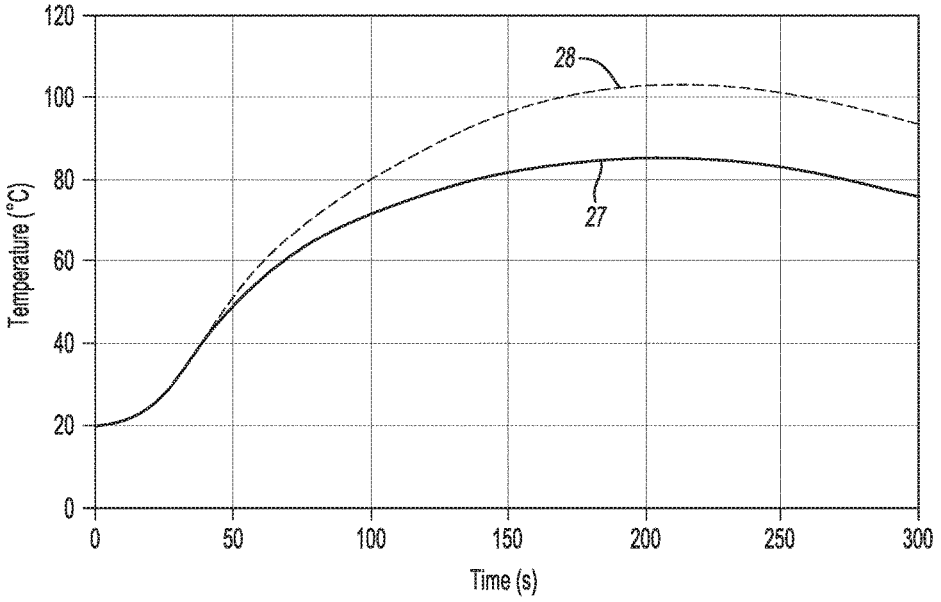
FIG. 8 is a graph comparing temperatures of a sixteenth pressure vessel in an array of pressure vessels as determined by computer simulation showing the effectiveness of replacing two Type 4 tanks with Type 1 stainless steel tanks according to the present disclosure.

FIG. 8 is a graph comparing temperatures of a sixteenth pressure vessel in an array 10 of pressure vessels 12 as determined by computer simulation showing the effectiveness of replacing two Type 4 pressure vessels 14 with Type 1 pressure vessels 11 formed from stainless steel according to the present disclosure. FIG. 8 graphs Temperature in degrees Centigrade vs. Time in seconds. Time zero is the beginning of filling of the tanks from 0 psig to 3600 psig. Reference numeral 27 indicates the average temperature of the sixteenth pressure vessel when the first 14 pressure vessels in the array were Type 4 pressure vessels each with a Hytrel® liner and a braided Kevlar® outer lining; the last two pressure vessels 12 (shaded gray in FIG. 4) in the array were Type 1 pressure vessels 11, in this particular simulation the Type 1 pressure vessels were made from stainless steel. Reference numeral 28 indicates the average temperature of the sixteenth pressure vessel when the array was entirely made from Type 4 pressure vessels each with a Hytrel® liner and a braided Kevlar® outer lining. As seen in FIG. 8, the peak temperature of the last segment 30 was reduced from over 100° C. to about 85° C. by replacing the last two Type 4 segments with two Type 1 segments.

Based on analysis of the 16 segment models described above, the inventors of the present disclosure have determined the following: If the fifteenth and sixteenth segments (shaded in FIG. 4) are stainless steel then the average temperature of gas in the fifteenth and sixteenth segments is reduced by about 12° C. The larger overall heat capacity of the stainless steel wall accounts for about 87% of this difference and enhanced convective losses to the environment account for about 13%. The relative contribution of each mechanism (convection, heat capacity) will depend on the Type 1 tank wall material (steel, aluminum etc.) and tank wall thickness. For example, if the wall is made thinner, convective losses would have greater relative influence on the total heat lost by the gas. It should be noted that Hytrel® has a higher gravimetric heat capacity than stainless steel; but stainless steel has a higher volumetric heat capacity than Hytrel®. Thus, wall thickness matters. In examples of the present disclosure, the Type 1 pressure vessel may be directly substituted for a Type 4 pressure vessel based on packaging considerations. Therefore, in order to match capacity and packaging, the wall thickness of the Type 1 pressure vessel may be the same as the wall thickness of the Type 4 pressure vessel.

The dissipation of pressure work heat by the at least one Type 1 pressure vessel 11 decreases localized temperature transients in the array 10. For example, the at least one Type 1 pressure vessel 11 may be to dissipate a sufficient amount of pressure work heat to prevent any portion of the array 10 of pressure vessels 12 from exceeding 85 degrees Celsius when the array 10 is filled at an average fast-fill flow rate of at least 4 GGE (Gasoline Gallon Equivalent) per minute for a fast-fill flow duration of a product of 5 minutes and a ratio of an array interior volume in United States Gallons over 76. It is to be understood that in the beginning of flow, the flow rate may be higher, (for example up to 8 GGE/minute) and at the end of flow, the flow rate decays rapidly.

A lower maximum temperature advantageously reduces thermal stress on Type 4 pressure vessel 14 wall materials for better tank durability and longer service life. For example, Hytrel® may lose chemical stability in the presence of water at elevated temperature; water is a common natural gas contaminant. Water, together with elevated temperatures, may lead to a gradual deterioration of a Hytrel® liner and thereby reduce the durability and service life of a Type 4 natural gas tank.

In examples of the present disclosure, each high aspect ratio Type 1 conformable tank segment that replaces one of the high aspect ratio Type 4 conformable tank segments acts as a heat sink. The Type 4 conformable tank segments may be called "primary" tank segments herein because the majority of the tank segments in the segmented conformable tank may be Type 4 conformable tank segments. Accordingly, the Type 1 tank segments may be called "secondary" tank segments herein.

The secondary tank segments may be a stainless steel Type 1 tank or any other tank with a highly thermally conductive wall. As an example, the secondary tank segments may be Type 1 tanks made from low carbon steel or aluminum. SAE 1010 steel has a thermal conductivity of about 59 W/(m·K). 6061-T6 aluminum has a thermal conductivity of about 163 W/(m·K).

As illustrated in FIGS. 6 and 7, the array 10 of pressure vessels 12 according to examples of the present disclosure includes pressure vessels 12 disposed about a portion of a vehicle trunk space 24 that is relatively less likely to be used than a central portion of the vehicle trunk space 24 (such that most of the volume of the pressure vessels 12 occupies the portion of a vehicle trunk space 24 that is relatively less likely to be used). FIG. 7 shows an example with a different arrangement of pressure vessels 12. In this example, with a spare tire 26 being stored under the vehicle trunk space 24 floor, the pressure vessels 12 are located off to the sides and in the rear of the vehicle trunk space 24. For example, the pressure vessels may be adjacent or beyond the hinge area for the deck lid (not shown). This would leave the more easily accessible portions of the vehicle trunk space 24 open for use.

In another example, the pressure vessels 12 are disposed along the underbody of the vehicle, thereby leaving all the trunk space 24 open for the operator use for storage space. In a further alternate example, the pressure vessels 12 may be distributed about any suitable open space in the vehicle.

It is to be understood that the ranges provided herein include the stated range and any value or sub-range within the stated range. For example, a range from 0 psig to 3600 psig should be interpreted to include not only the explicitly recited limits of 0 psig to 3600 psig, but also to include individual values, such as 100 psig, 500 psig, 1800 psig, etc., and sub-ranges, such as from about 50 psig to about 3200 psig; from about 25 psig to about 750 psig, etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

It is to be understood that the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

Furthermore, reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

While several examples have been described in detail, it is to be understood that the disclosed examples may be modified. Therefore, the foregoing description is to be considered non-limiting.

What is claimed is:

1. An array of pressure vessels for storage of a compressed gas, comprising:

at least one Type 4 pressure vessel; and at least one Type 1 pressure vessel in fluid communication with the at least one Type 4 pressure vessel, wherein a metal wall of the at least one Type 1 pressure vessel has a Type 1 thermal conductance that is greater than a Type 4 thermal conductance of the at least one Type 4 pressure vessel and a thermal conductivity of the at least one Type 1 pressure vessel is from about 20 Watts per meter per degree Kelvin to about 163 Watts per meter per degree Kelvin.

2. The array of pressure vessels as defined in claim 1 wherein the metal wall of the at least one Type 1 pressure vessel is made of steel, stainless steel or aluminum.

3. The array of pressure vessels as defined in claim 1 wherein the at least one Type 4 pressure vessel is a plurality of Type 4 pressure vessels in series fluid communication.

4. The array of pressure vessels as defined in claim 3 wherein the at least one Type 1 pressure vessel is a plurality of Type 1 pressure vessels in series fluid communication.

5. The array of pressure vessels as defined in claim 3 wherein the Type 4 pressure vessels are sequenced to receive a gas before the Type 1 pressure vessel when the gas is introduced into the array of pressure vessels.

6. The array of pressure vessels as defined in claim 3 wherein the array of pressure vessels terminates with the at least one Type 1 pressure vessel.

7. The array of pressure vessels as defined in claim 1 wherein the at least one Type 1 pressure vessel is to dissipate a sufficient amount of pressure work heat to prevent any portion of the array of pressure vessels from exceeding about 82 degrees Celsius when the array is filled at an average fast-fill flow rate of at least 4 GGE (Gasoline Gallon Equivalent) per minute for a fast-fill flow duration of a product of 5 minutes and a ratio of an array interior volume in United States Gallons over 76.

8. The array of pressure vessels as defined in claim 1, wherein:

the array of pressure vessels has a total capacity of 14 liters;

a quantity of the at least one Type 4 pressure vessels is 14 Type 4 pressure vessels; and the plurality of Type 1 pressure vessels consists of two of the at least one Type 1 pressure vessels.

9. The array of pressure vessels as defined in claim 1, wherein:

a Type 1 outer diameter of the at least one Type 1 pressure vessel is equal to a Type 4 outer diameter of the at least one Type 4 pressure vessel within manufacturing tolerances; and a Type 1 length of the at least one Type 1 pressure vessel is equal to a Type 4 length of the at least one Type 4 pressure vessel within manufacturing tolerances.

10. A vehicle comprising the array of pressure vessels as defined in claim 1.

11. An array of pressure vessels for storage of a compressed gas, comprising:

at least one Type 4 pressure vessel; and at least one Type 1 pressure vessel in fluid communication with the at least one Type 4 pressure vessel, wherein a metal wall of the at least one Type I pressure vessel has a Type 1 thermal conductance that is at least 100 times the Type 4 thermal conductance.

12. The array of pressure vessels as defined in claim 11 wherein the at least one Type 4 pressure vessel is a plurality of Type 4 pressure vessels in series fluid communication.

13. The array of pressure vessels as defined in claim 12 wherein the at least one Type 1 pressure vessel is a plurality of Type 1 pressure vessels in series fluid communication.

14. The array of pressure vessels as defined in claim 12 wherein the Type 4 pressure vessels are sequenced to receive a gas before the Type 1 pressure vessel when the gas is introduced into the array of pressure vessels.

15. The array of pressure vessels as defined in claim 12 wherein the array of pressure vessels terminates with the at least one Type 1 pressure vessel.

16. An array of pressure vessels for storage of a compressed gas, comprising:

at least one Type 4 pressure vessel; and at least one Type 1 pressure vessel in fluid communication with the at least one Type 4 pressure vessel, wherein a metal wall of the at least one Type 1 pressure vessel has a Type 1 thermal conductance that is greater than a Type 4 thermal conductance of the at least one Type 4 pressure vessel and the at least one Type 4 pressure vessel has a Type 4 aspect ratio greater than or equal to 10, and wherein the at the at least one Type 1 pressure vessel has a Type 1 aspect ratio greater than or equal to 10.

17. The array of pressure vessels as defined in claim 16 wherein a thermal conductivity of the at least one Type 1 pressure vessel is from about 20 Watts per meter per degree Kelvin to about 163 Watts per meter per degree Kelvin.

* * * * *